United States Patent [19]

Matsushima et al.

[11] 4,063,968

[45] Dec. 20, 1977

[54] FORMATION OF NICKEL PHOSPHATE COATINGS ON IRON OR STEEL

[75] Inventors: Yasunobu Matsushima, Kawasaki; Shigeo Tanaka, Yokohama; Akira Niizuma, Tokyo, all of Japan

[73] Assignee: Oxy Metal Industries Corporation, Warren, Mich.

[21] Appl. No.: 617,757

[22] Filed: Sept. 29, 1975

[30] Foreign Application Priority Data

Oct. 4, 1974 Japan ..... 49-113766

[51] Int. Cl.[2] ..... C23F 7/10

[52] U.S. Cl. ..... 148/6.15 R; 427/409; 427/419 E

[58] Field of Search ..... 148/6.15 R, 6.15 Z; 427/409, 419 E

[56] References Cited

U.S. PATENT DOCUMENTS

| | | | |
|---|---|---|---|
| 2,164,042 | 6/1939 | Romig | 148/6.15 Z |
| 3,268,367 | 8/1966 | Nelson | 148/6.15 Z |
| 3,307,979 | 3/1967 | Upham | 148/6.15 Z |
| 3,864,139 | 2/1975 | Heller | 148/6.15 R |

OTHER PUBLICATIONS

Wiederholt, W., *The Chemical Surface Treatment of Metals,* Robert Draper Ltd., 1965.

*Primary Examiner*—Ralph S. Kendall

*Attorney, Agent, or Firm*—Arthur E. Kluegel; Bertram F. Claeboe; Richard P. Mueller

[57] ABSTRACT

Disclosed is a composition and process useful in forming a nickel phosphate coating on an iron or steel surface.

3 Claims, No Drawings

FORMATION OF NICKEL PHOSPHATE COATINGS ON IRON OR STEEL

BACKGROUND OF THE INVENTION

The present invention relates to a process for forming a phosphate conversion on iron or steel. More particularly, it relates to a composition and process for forming a nickel phosphate coating on iron or steel. The applied coating is suitable as an undercoating for painting, as a solid lubricant for cold working or as an undercoating for ceramic or porcelain enameled ironwork.

In order to improve corrosion resistance and adhesive properties, surfaces of iron or steel have previously been coated with a film of a slightly soluble metal phosphate. For this purpose, the surface has been reacted with an acidic aqueous metal phosphate solution which resulted in the inclusion of the metal cation in thus-formed film. Originally, iron phosphate or manganese phosphate was used. In recent years, however, zinc phosphate compounds have been employed. Besides the zinc ion, these phosphate conversion solutions often contain added film forming divalent metal ions such as calcium, manganese, iron, nickel, cobalt or cadmium ions.

In such cases, these added cations represent a minor proportion of the film-forming cations with the zinc ion predominating.

Moreover, it is well known that such phosphate conversion solutions may be modified with various additives such as Cu salts, Ti salts, boric acid, silicic acid, as well as single and complex fluorides. Zinc phosphate conversion solutions to which a minor amount of nickel ion is added have been hitherto used as a phosphate conversion solution, but this added nickel ion is effective only as a reaction accelerator to produce the zinc phosphate film. The amount of the crystalline nickel phosphate existing in the zinc phosphate film is so extremely small that X-ray diffraction cannot detect it. Japanese Prepublished Application No. 14028/72 discloses a process of phosphate conversion coating using a nickel phosphate bath, but in this case, the formation of crystalline nickel phosphate coating film was difficult and the resulting film was so very thin that it was difficult to detect the nickel phosphate by X-ray diffraction.

There are known processes designed to precondition the surface by immersing the surface in a titanium phosphate solution or by spraying the same solution. It is also known to precondition the surface by immersing the material in an aqueous suspension of fine powders of zinc phosphate, iron phosphate or calcium phosphate or by spraying the same suspension on the material. Following preconditioning, the surface is then treated to form the adherent zinc phosphate coating by treating the preconditioned surface with zinc phosphate conversion solution. It was found difficult, however, to form a crystalline nickel phosphate coating on such preconditioned surfaces by treatment with a nickel phosphate conversion solution.

These conventional phosphate conversion processes have not been entirely satisfactory. For example, in the case of phosphate conversion of strip material, it is difficult to obtain an adherent phosphate film in a short time. In addition, the phosphate film obtained by the conventional method lacks the desired stability in mechanical treatment such as bending and deep drawing, and in such cases cracks or peeling of phosphate film or of paints thereon are observed.

SUMMARY OF THE INVENTION

It has now been discovered that the formation of a crystalline film consisting of strong, fine and adherent nickel phosphate [$Ni_3(PO_4)_2 7H_2O$] on the surface of iron or steel can be obtained by surface-preconditioning and phosphate conversion with an aqueous nickel phosphate solution which contains a hydroxycarboxylic acid. Iron or steel used in the present invention are cleaned by known rinsing treatment with water after alkali degreasing.

DETAILED DESCRIPTION OF THE INVENTION

Preconditioning may be accomplished by scotch abrasion using the commercially available Sumitomo 3M Company's abrasives. As an alternate, an alkali phosphate solution which contains suspended nickel phosphate crystals can be prepared by dissolving 0.5–10 g/l, preferably 1–3 g/l of sodium dihydrogenphosphate, disodium hydrogenphosphate, sodium pyrophosphate or sodium phosphate in the water and then suspending 0.5–20 g/l of crystalline fine powders of nickel phosphate in this aqueous solution. To make this suspension, the alkali phosphate solution having pH value of 8–12, preferably 10–12, for example in practice, 1 g/l of disodium hydrogenphosphate solution in case of pH 8, 1 g/l of sodium pyrophosphate solution in case of pH 10, or 1 g/l of sodium phosphate solution in case of pH 12 may be used under recycling and stirring. The iron or steel is treated with the alkali phosphate solution containing suspended crystalline powder of nickel phosphate via any well known method such as immersion or spraying. Suitable contact periods in the case of immersion method are from 30 seconds to 3 minutes and in the case of spraying, are from 5 to 60 seconds. As the preferred treating condition, the pH value is 10–12, the concentration of crystalline powders of nickel phosphate is 3–5 g/l, the period of immersion is 1 minute or the period of spraying is 15–30 seconds.

After the foregoing preconditioning, the surface is conversion-coated with nickel phosphate. The nickel phosphate conversion solution contains 1–10 g/l, preferably 3–5 g/l of hydroxycarboxylic acid such as salicylic, gallic, lactic, tartaric, citric, malic, glyceric, glycolic, mandelic and tropic acids; 3–50 g/l, preferably 5–20 g/l of phosphate (as $P_2O_5$), 0.5–20 g/l, preferably 2–6 g/l of nickel, and 1–40 g/l, preferably 1–10 g/l of nitric acid (as $NO_3$). If desired, known accelerators such as chlorates and fluorides may be used. The acceptable range of Total Acid value of the phosphating solution is 10–50 points and the range of Free Acid value is 1.0–5 points. (The Total Acid is the number of milliliters of 0.1 N NaOH solution required to neutralize a 10 ml of the sample solution using phenolphthalein as the indicator, and the Free Acid is determined in the same manner using bromophenol blue.) As the treating conditions of the methods of immersion and spraying for iron or steel, the temperature of the bath is maintained at 50–70° C during the time from 30 seconds to 15 minutes. After this treatment, the material is washed and then dried.

The external appearance of the phosphate film is of bluish-green color and the weight of film is 3–10 g/m$^2$.

Nickel phosphate film formed according to this invention has excellent adhesion and corrosion resisting properties as an undercoat for the application of organic paints and also has a good adhesive property as an undercoat for ceramic coating, e.g., porcelain enamel.

The present invention is illustrated by the examples as follows:

EXAMPLE 1

A steel panel of thickness 0.8 mm was cleaned by the usual alkali degreasing solution. It was then treated by first immersing for 1 minute into the solution which had suspended therein 5 g/l of fine powder of nickel phosphate in 1 g/l of sodium phosphate solution having pH 12, at room temperature and subsequently by immersing into a phosphate conversion solution heated to a temperature of 60° C. The phosphate solution contained 5 g/l of Ni, 10.6 g/l of $PO_4$, 5.3 g/l of $NO_3$ and 5 g/l of salicylic acid and had 20 points total acid value and 1.3 points of free acid value. The surface was then rinsed with water and dried by warm air. The weight of nickel phosphate film of this example was 8–10 g/m$^2$.

Subsequently, the thus-treated steel plate was coated with alkyd-melamine resin to a thickness of about 20$\mu$ and baked in hot air for 30 minutes at a temperature of 130° C. 100% adhesion of the paint was obtained when the surface was cross-hatched at 1 mm intervals and tape-pulled. When an identical panel was treated in the same manner and subjected to salt spray for 200 hours (according to JIS Z 2371), results were as good as those obtained using a zinc phosphate comparative.

EXAMPLE 2

The surface of steel plate (0.9 mm thickness) was cleaned by the usual aqueous alkali degreasing solution. It was then treated by spraying for 30 seconds with an aqueous solution containing crystalline fine powders of nickel phosphate, 1 g/l of sodium phosphate and having pH 12, and subsequently phosphated by immersing in a phosphate conversion solution heated to a temperature of 60° C for 10 minutes, the solution containing 10 g/l of nickel, 35 g/l of $PO_4$, 15 g/l of $NO_3$ and 5 g/l of salicylic acid and having 50 points Total Acid value and 3 points Free Acid value. The treated steel plate was then rinsed with water and dried. The surface was then sprayed with an enamel glaze containing:

| | |
|---|---|
| (a) Frit (Nihon Ferro No. 2024) | 100 parts |
| (b) Gairome Clay | 6–7 parts |
| (c) Borax | 0–5 parts |
| (d) Sodium Nitrite | 0.25 parts |
| (e) Water | 45–50 parts |

having a specific gravity of 1.7–1.75 after ball milling. The resulting particle size was such that 6–8g were retained when 50 ml of the glaze were passed through a 200 mesh sieve. The enamel was then dried for 30 minutes at a temperature of 80° C and then baked at 830° C for 3 minutes. The thickness of the enamel was 80$\mu$. The adhesiveness of this enamel was indicated as 90–100% enamel retention by measuring the peeled state with a porcelain Enamel Institute meter after a 4 mm extrusion using the Erichsen Testing Machine. This showed its performance was better compared to the conventional acid washing Ni flash method.

What is claimed is:

1. A process for forming a protective crystalline nickel phosphate coating on an iron or steel surface comprising first contacting the surface with an alkaline alkali metal phosphate solution exhibiting a pH of from 8 to 12 containing 0.5–20 g/l of nickel phosphate suspended therein and thereafter contacting the surface with an aqueous composition consisting essentially of:

1 – 10 g/l of hydroxy carboxylic acid selected from the group consisting of salicylic, gallic, lactic, tartaric, citric, malic, glyceric, glycolic, mandelic and tropic acids 3–50 g/l of phosphate (as $P_2O_5$)

2–6 g/l of nickel and having a Total Acid value of 10–50 points and a Free Acid value of 1–5 points, whereby a crystalline coating of nickel phosphate is formed on the surface.

2. The process of claim 1 wherein a ceramic coating is subsequently applied to the treated surface.

3. The process of claim 1 wherein paint is subsequently applied to the treated surface.

* * * * *